United States Patent [19]

Martin

[11] 3,998,519

[45] Dec. 21, 1976

[54] LAMP SUPPORT

[75] Inventor: Wilbert A. Martin, Arvada, Colo.

[73] Assignee: Honeywell Inc., Minneapolis, Minn.

[22] Filed: July 2, 1973

[21] Appl. No.: 375,939

[52] U.S. Cl. ..... 339/258 R; 339/177 L; 339/119 L

[51] Int. Cl.[2] ..... H01C 1/02

[58] Field of Search ..... 339/258 R, 258 C, 256 R, 339/256 C, 256 T, 177 L, 176 L, 119 L, 258 T; 24/73 CP, 81 B, 81 CR, 81 CL, 81 G, 257, 259 C, 201 S; 403/360, 395, 397, 398, 399

[56] References Cited

UNITED STATES PATENTS

| | | | |
|---|---|---|---|
| 2,858,631 | 11/1958 | Jorick | 339/176 L |
| 2,923,305 | 2/1960 | Tinnerman | 24/259 C |
| 3,004,370 | 10/1961 | Tinnerman | 24/81 CR |

FOREIGN PATENTS OR APPLICATIONS

| | | | |
|---|---|---|---|
| 1,084,335 | 6/1960 | Germany | 24/81 G |

OTHER PUBLICATIONS

Aviation Week, 8-1962.

*Primary Examiner*—Robert A. Hafer
*Attorney, Agent, or Firm*—Philip J. Zrimsek

[57] ABSTRACT

A support for a flange base electrical lamp which is of unitary construction and of channel shape where the lamp is held in place by the flange being disposed in openings provided in the upright members of the channel shaped support.

6 Claims, 4 Drawing Figures

LAMP SUPPORT

The present invention is directed to a support for a flange base electrical lamp.

Conventionally, supports for flange base lamps include cylindrical openings each of which accommodates and through the use of auxiliary fastening means holds the cylindrical tubular body portion of the lamp with the flange of the lamp acting to limit inward movement thereof. This form of construction, as shown in the Hayes U.S. Pat. No. 2,769,974, usually involves lamping and relamping from the "back" of the support.

My invention bypasses the conventional approach and involves a discrete element to both accommodate and hold the flange base lamp. Further, with my lamp support, the flange base lamp can be lamped and relamped from the "front" of the support. Thus, in my preferred embodiment, I utilize a channel shaped support formed of resilient, electrically conductive material which includes "V"-shaped openings in the upright members. The spacing of the members and the form of the "V"-shape openings is so chosen as to allow initial insertion of the flange of the flange base lamp into the openings thereby causing movement of the upright members away from each other and against the inherent bias. This movement of the upright members allows further insertion of the flange of the flange base lamp into the openings so as to ultimately be accommodated in pairs of oppositely disposed notches provided in the openings thereby holding the flange and hence the flange base lamp in place in the support. To remove the flange base lamp merely requires the flange to be forced out of the notches and causing the upright members to again be moved away from each other and against the inherent bias.

My approach, as will become clearer below, involves simplicity not only in terms of tooling but in manufacture as well thereby leading to a low cost flange base lamp support.

Therefore, it is an object of my invention to provide a support for a flange base electrical lamp which allows for ease of insertion and removal thereof from the "front" of the support.

It is a further object of my invention to provide a flange base lamp support which allows for low cost tooling and manufacture.

These and other objects will become more apparent from a reading of the following specification and appended claims taken in conjunction with the drawings in which:

Figure 1:
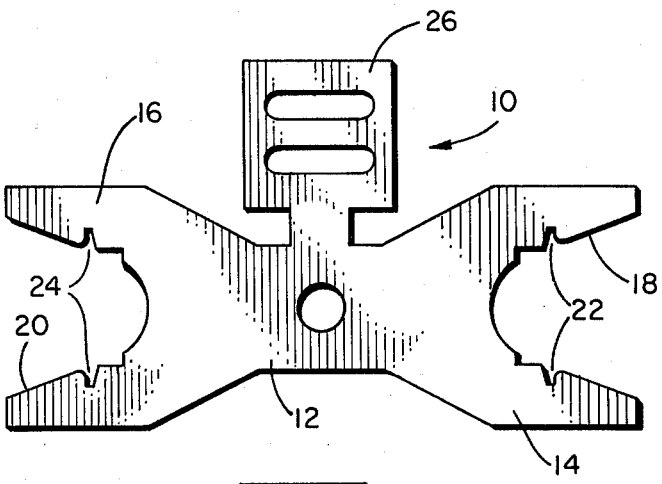
FIG. 1 is a view of the lamp support of the invention shown in blanked form.
Figure 2:
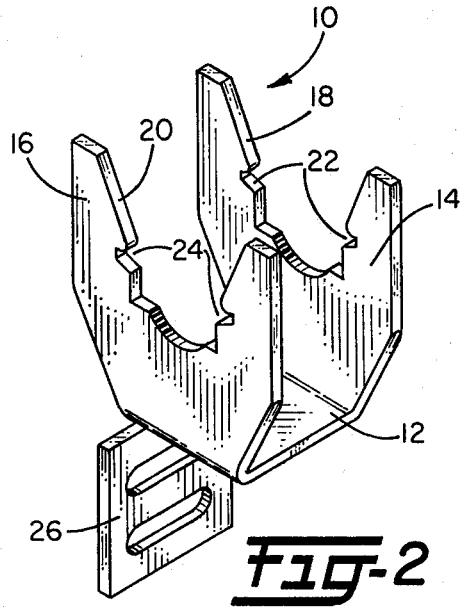
FIG. 2 is a view of the lamp support in formed condition and presenting the channel shape.

In FIG. 1, the blanked form of a flange base lamp support 10 incorporating the invention is shown. The support 10 is preferably comprised of a resilient, electrically conductive material such as copper which when formed by bending provides a channel shape as shown in FIG. 2. It will be appreciated that the blanked form of the support 10 and the bending to provide the channel shape can be accomplished with low cost tooling and straightforward manufacturing techniques.

Referring now to FIGS. 1 and 2, the support 10 includes a mid or base portion 12 connecting end portions 14 and 16 which when the support is formed to its channel shape by bending become substantially parallel upright members. Because of the resilient nature of the copper material from which the support 10 is fabricated, the members 14 and 16 are pivotally movable about the hinge bend formed between the members and the base portion 12 and against the inherent bias thereby provided.

The end portions or members 14 and 16 each include a substantially "V"-shape opening 18 and 20, respectively, at the outer extremity. The "V"-shape openings 18 and 20 are preferably symmetrical and so provided as to be oppositely disposed to each other with the support 10 in the formed condition. Pairs of notches 22 and 24 are provided in the "V"-shape openings 18 and 20, respectively, and preferably are located opposite to each other, and to the notches of the other opening with the support 10 in the formed condition.

The support 10 (as shown in FIGS. 1 and 2 only) includes a tab 26 to which an electrical line may be connected.

Figure 3:
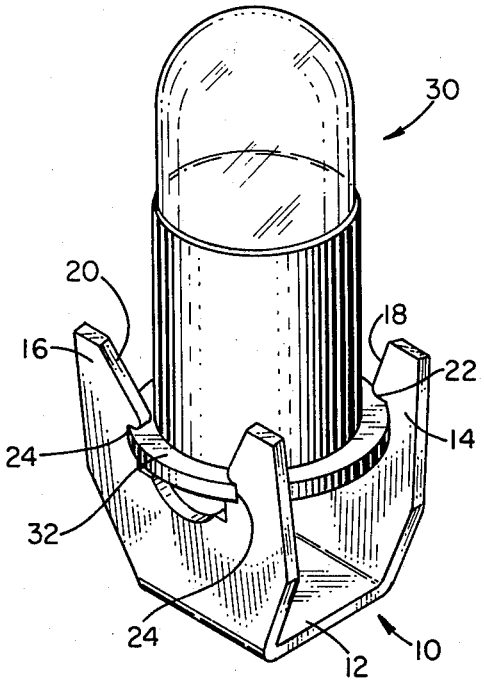
FIG. 3 is a view of the lamp support with a flange base lamp in place.

As shown in FIG. 3, a flange base electrical lamp 30 is associated with the support 10 such that the flange 32 of the lamp is accommodated and held in the pairs of notches 22 and 24.

Figure 4:
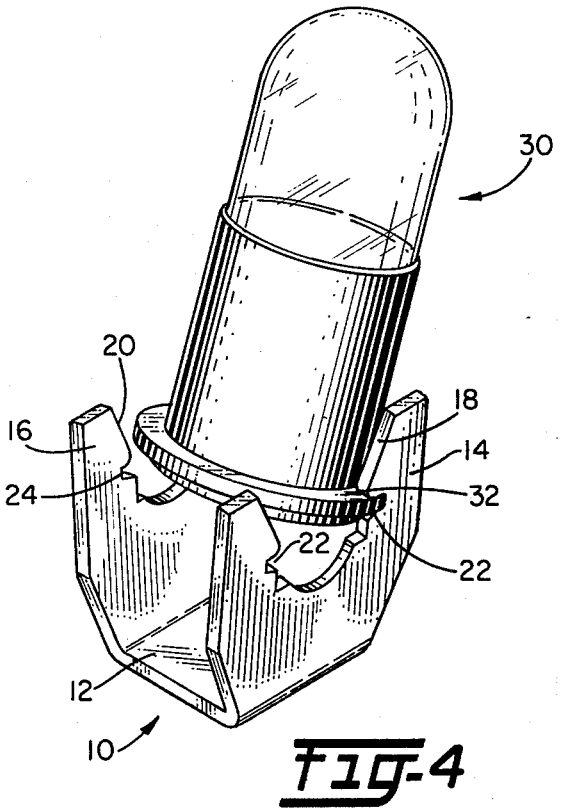
FIG. 4 is a view of the lamp support with the flange base lamp partially in place.

In arriving at the condition shown in FIG. 3, the lamp 30 can be assembled to the support in the manner suggested in FIG. 4. There, as shown, the flange 32 has been introduced into one each of the pairs of notches 22 and 24, the latter not shown. To complete the assembly, initial pivotal movement of the lamp 30 is required so as to cause engagement of the flange 32 with the upper surfaces of the "V"-shape openings 18 and 20 opposite the notches 22 and 24 already engaged by the flange 32. Because of the relative diameter of the flange 32 and the spacing of members 14 and 16 from each other, further pivotal movement of the lamp 30 causes a camming action to take place between the flange 32 and the surfaces of the openings 18 and 20 just referred to resulting in members 14 and 16 being moved away from each other and against their inherent bias. Ultimately, the pivotal movement of the members 14 and 16 provided by the camming action allows the flange 32 to be accommodated in the notches 22 and 24 provided in the surfaces of the openings under consideration whereupon the lamp 30 will be held in place. The lamp can be removed by merely reversing the above-described sequence after the flange 32 has been cammed or forced out of an oppositely disposed set of notches 22 and 24.

Alternatively, the lamp 30 can be assembled to the support 10 by initially having the flange 32 engage the "V"-shape openings 18 and 20 at four points oppositely disposed with respect to each other and then pushing the lamp 30 along an axis normal to the base portion 12. This mode also gives rise to the camming action previously referred to and ultimately results in the flange 32 being accommodated by the pairs of notches 22 and 24 and the lamp 30 being held in place.

Also alternatively, the lamp 30 can be removed from the support 10 by moving the lamp along an axis parallel to the longitudinal axis of the channel shape of the support 10. The camming action also takes place in this mode allowing the flange 32 to be freed from the notches 22 and 24 and consequently from the support 10.

While not shown, it will be appreciated that a second electrical termination is required for the lamp and this can be provided in any number of ways as can be provided by those skilled in the art.

From the foregoing, it is apparent my inventive concept allows for a flange base lamp support which can be lamped and relamped with ease from the "front" of the support. In practice the support firmly holds the lamp and does so even when exposed to shock and vibration.

The preferred embodiment of my invention has been disclosed. However, other forms of my invention are possible. For example, it would not be necessary that both upright members be resilient. Also, it would not be necessary to form the support out of resilient material relying instead on an external bias to allow the camming action to take place. Further, one of the "V"-shape openings could be in the form of an opening merely connecting a set of notches whereby the lamp could be introduced into this just described opening and by cam action forced into the set of notches of the remaining "V"-shape opening. The foregoing is merely illustrative of the various embodiments which might be provided utilizing my inventive concept. Therefore, the scope of my invention should be determined from the following claims.

I claim:

1. A support for a flange base electrical lamp comprising:

a. a pair of substantially parallel, spaced, facing and co-extending members;

b. said members each having a corresponding extremity affixed to a base portion and at least one of said members biased so as to allow limited pivotal movement thereof against said bias and away from the other member;

c. the extremity opposite the fixed extremity of said members each including an opening which together accommodate and hold the flange of a flange base lamp;

d. at least one of said openings being substantially "V"-shape in form and including a pair of oppositely disposed notches;

e. said members spaced to allow said limited pivotal movement against said bias upon insertion of the flange of a flange base lamp into said openings and until accepted by said notches;

f. said members also spaced to allow said limited pivotal movement against said bias upon removal of the flange of a flange base lamp from said openings brought about by the flange being moved and forced out of said notches.

2. The arrangement of claim 1 wherein both of said members are planar and biased and both said openings are alike, symmetrical and substantially "V"-shape in form, oppositely disposed with respect to that of the other member and include a pair of oppositely disposed notches.

3. The arrangement of claim 2 wherein said members and the base portion are integral so as to provide a discrete component.

4. The arrangement of claim 3 wherein said discrete component is of channel shape and formed of a single piece of material.

5. The arrangement of claim 4 wherein said material is resilient and the bias acting on said members is provided by the hinge action of said members where joined by the base portion.

6. The arrangement of claim 5 wherein the material is electrically conductive.

* * * * *